US005697293A

United States Patent [19]

Mogenier

[11] Patent Number: 5,697,293

[45] Date of Patent: Dec. 16, 1997

[54] WASTE SUCTION AND STORAGE DEVICE

[75] Inventor: Daniel Mogenier, Meyzieu, France

[73] Assignee: Delta Neu (S.A.), France

[21] Appl. No.: 497,391

[22] Filed: Jun. 30, 1995

[51] Int. Cl.[6] ..... B30B 15/14; B30B 15/08; B30B 9/30

[52] U.S. Cl. ..... 100/50; 15/301; 15/348; 55/315; 55/395; 55/430; 100/91; 100/97; 100/102; 100/145

[58] Field of Search ..... 100/48, 50, 91, 100/94–97, 102, 145; 15/301, 310, 339, 348, 352, 353; 55/300, 315, 385.1, 395, 429, 430, 432

[56] References Cited

U.S. PATENT DOCUMENTS

| | | | |
|---|---|---|---|
| 983,293 | 2/1911 | Kundig-Honegger | 55/430 |
| 1,314,437 | 8/1919 | Silverthorne | 100/102 |
| 1,704,241 | 3/1929 | Brown | 15/301 |
| 2,944,629 | 7/1960 | Eissmann | 55/430 |
| 3,120,432 | 2/1964 | Aldrich | 55/315 |
| 3,189,286 | 6/1965 | O'Connor | 100/97 |
| 3,222,853 | 12/1965 | Michael | 55/430 |
| 3,550,527 | 12/1970 | Sinitsin et al. | 100/97 |
| 3,636,864 | 1/1972 | Loscialo | 100/91 |
| 4,115,896 | 9/1978 | Costanzo | 15/301 |
| 4,121,514 | 10/1978 | Nickaloff | 100/91 |
| 4,133,658 | 1/1979 | Callewyn | 55/315 |
| 4,443,997 | 4/1984 | Namdari | 100/102 |
| 5,013,343 | 5/1991 | Miyamoto | 55/395 |
| 5,317,783 | 6/1994 | Williamson | 15/352 |
| 5,428,864 | 7/1995 | Pemberton | 15/348 |

FOREIGN PATENT DOCUMENTS

| | | | |
|---|---|---|---|
| 969290 | 5/1958 | Germany | 55/315 |
| 3825773 | 2/1990 | Germany | 15/348 |
| 3-288701 | 12/1991 | Japan | 100/96 |
| 4-313512 | 11/1992 | Japan | 100/145 |

*Primary Examiner*—Stephen F. Gerrity
*Attorney, Agent, or Firm*—Ladas & Parry

[57] ABSTRACT

The waste suction and storage device includes a box (3) which, on the one hand, comprises waste storage means and at least one separation compartment (6) whose lower part is open and connects with the waste storage means and which, on the other hand, is equipped with ventilation means and includes a waste introduction opening and an air discharge opening (15). According to the invention, the ventilation means consist at least of a first fan (5) which is placed inside the box (3), has its suction orifice (8) connected, towards the outside of the box (3), to a waste collection pipe and has its delivery orifice (7) leading into the upper part (6*a*) of the separation compartment (6) so that the air flow delivered by the first fan (5) is projected substantially horizontally into the separation compartment (6); the device furthermore comprises a grille (9), for separation of air and waste, which is interposed between the separation compartment (6) and the discharge opening (15) of the box (3), and which is inclined downwards from the delivery orifice (7) of the first fan (5).

13 Claims, 3 Drawing Sheets

FIG. 2
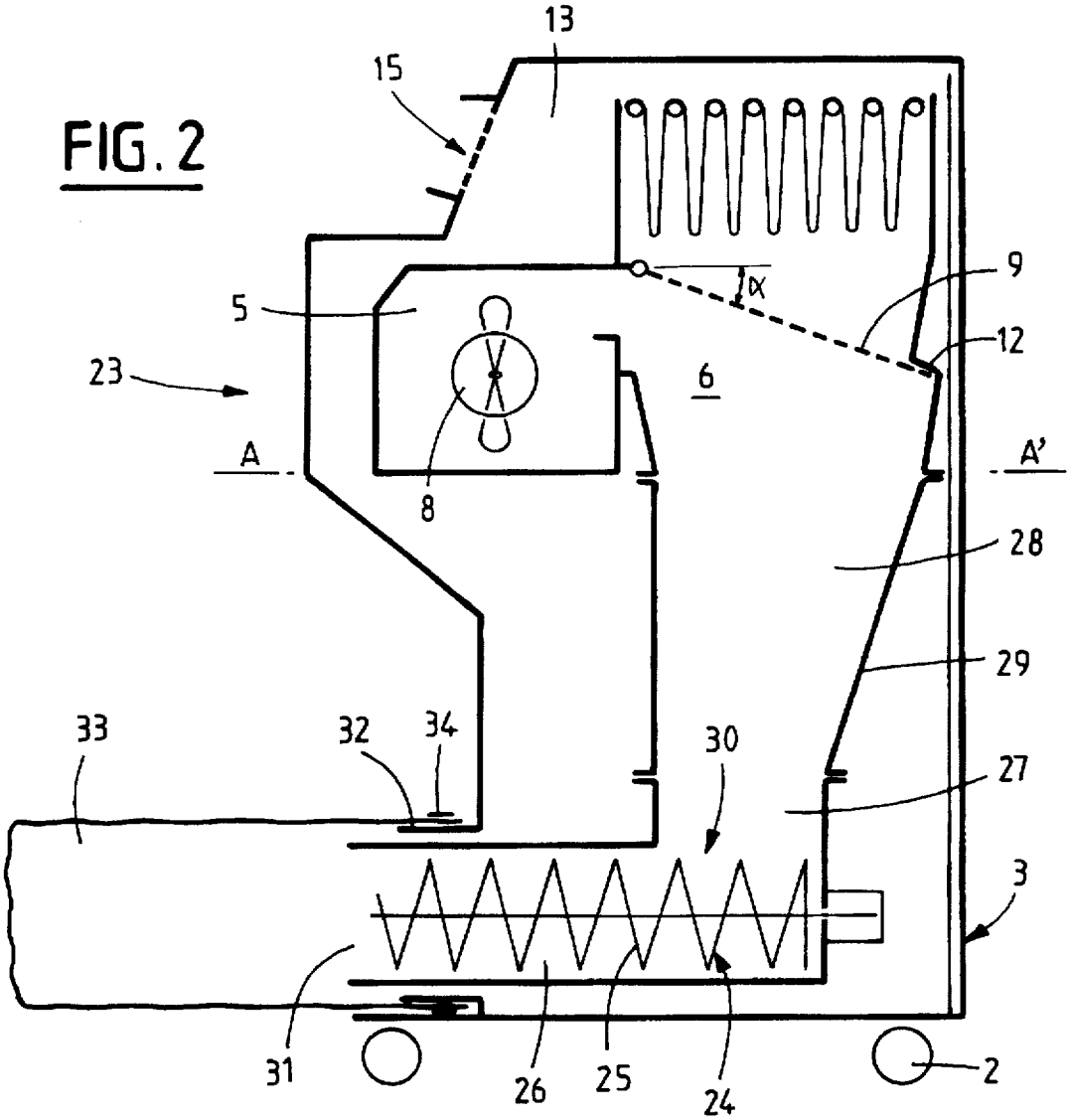
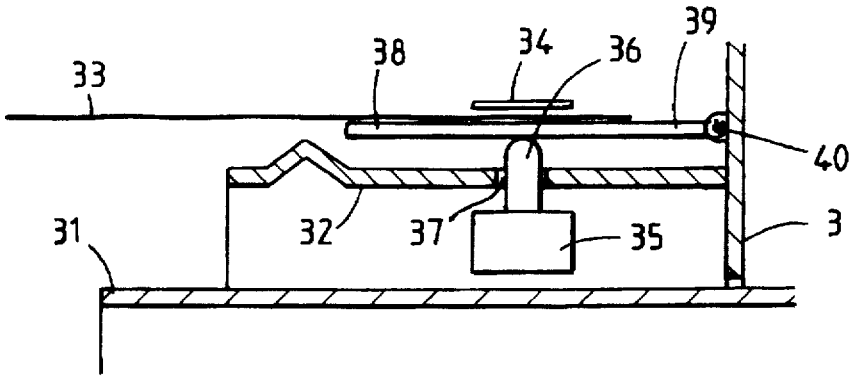
FIG. 3

WASTE SUCTION AND STORAGE DEVICE

This application originates from French patent application No. 9402418 filed Feb. 25, 1994 and European patent application No. 94490013.3 filed Apr. 5, 1994. Said documents are incorporated herein by reference.

FIELD OF THE INVENTION

The present invention relates to the recovery and storage of waste coming from production machines, the said recovery being carried out directly by collecting the waste from the machine. It more particularly relates to an autonomous and mobile device especially designed for collecting and storing waste coming from computer equipment, which waste is in the form of perforated paper strips, also called sprocket-hole strips.

To the knowledge of the Applicant, there is no equipment especially designed for collecting and storing sprocket-hole strips. Behind each computer unit which generates such strips, a recovery bin is placed in which this waste accumulates. In normal operation, some computer machines can generate up to 20 meters per minute of sprocket-hole strips. It is known that the accumulation of such a quantity of strips can cause storage problems in a computer room having several machines of this type.

BACKGROUND OF THE INVENTION

In the field of recovering fine particles coming from milling machines, devices have already been proposed, especially in documents GB 941,841 and DE 41 11 031, which make it possible to clear these fine particles from the air. More particularly the first document describes an apparatus comprising a box, having a separation compartment, which includes in its lower part an inlet opening for the dust coming from the mill and which is equipped in its upper part with a filter made of textile material. A fan is mounted outside the box, making it possible to create, by suction, an air flow within the box, from the inlet opening to a discharge opening which is made in the upper wall of the box. The air sucked in at the entry of the inlet opening is loaded with particles of different sizes. The heaviest particles fall to the bottom of the box before reaching the filter; the finest particles are conveyed by the rising air to the filter, on which they are deposited.

These devices, described in the two aforementioned documents, are unsuitable for collecting bulky waste and more particularly waste of the sprocket-hole strip type. The same collection and storage problem is similarly encountered with other types of production machines which generate waste in the form of continuous or discontinuous tape or else solid waste of small size, for example cuttings from machining plastics, for example polytetrafluoroethylene which is more commonly known by the trademark Teflon or else aluminium pieces in pellet form.

OBJECT AND SUMMARY OF THE INVENTION

The objective set by the Applicant is to provide a compact device which can be placed in proximity to one or more production machines which generate such waste and which can collect and store the waste produced by the said machine or machines without being a hindrance to the operators.

This objective is perfectly achieved by the device of the invention which, in a known manner, includes a box which, on the one hand, comprises waste storage means and at least one separation compartment whose lower part is open and connects with the waste storage means and which, on the other hand, is equipped with ventilation means and includes a waste introduction opening and an air discharge opening.

Characteristically, the ventilation means consists at least of a first fan which is placed inside the box, has its suction orifice connected, towards the outside of the box, to a waste collection pipe and has its delivery orifice leading into the upper part of the separation compartment so that the air flow delivered by the first fan is projected substantially horizontally into the separation compartment; the device furthermore comprises a grille, for separation of air and waste, which is interposed between the separation compartment and the discharge opening of the box, and which is inclined downwards from the delivery orifice of the first fan.

The waste is picked up from the production machine using the collection pipe, is sucked into the pipe, passes through the first fan and is projected into the separation compartment. The delivery air passes through the grille and leaves the device via the discharge opening. For its part, the waste, by virtue of the presence of the grille, falls to the bottom of the separation compartment down to the storage means. The positioning and inclination of the grille with respect to the delivery orifice of the first fan allow the waste picked up to slide along the grille, without risk of catching or accumulation.

Advantageously, in the case of waste in the form of continuous paper strips, the first fan includes a wheel provided with blades, which makes it possible to obtain shredding of the continuous strips at the entry of the separation compartment and thereby to promote the air/waste separation.

For preference, when there is a risk of an excessive overpressure being set up within the box, the device comprises additional ventilation means which are connected to the discharge opening of the box and which allow discharge of the air contained in the box, with a flow rate which is sufficient to compensate at least partly for the overpressure within the box. This overpressure phenomenon is in fact particularly detrimental when the separation compartment connects onto unsealed storage means, for example a baling press.

These additional ventilation means may be external to the box, being connected to the discharge opening of the box, for example by a hose. For preference, in order to produce an autonomous device, these ventilation means are integrated with the box. In this case, they consist of a second fan which is fixed in the box at the level of the discharge opening; in this case, the discharge opening is equipped with a means, of the graduated ring type, for regulating the air flow rate.

When the air delivered by the first fan into the separation compartment is strongly loaded with very fine particles or dust, the latter are not intercepted by the separation grille. In order to purify this air, after it has passed through the separation grille and before it leaves via the discharge opening, the box advantageously comprises a filtration compartment which is located above the separation compartment and a filtration system which is placed in the filtration compartment, between the separation grille and the discharge opening of the box.

According to a first alternative embodiment, the filtration system may consist of a disposable static filter. In this case, the separation grille is fixed.

According to a second alternative embodiment, the filtration system consists of a dust bag which is placed just above the separation compartment and which is provided with vibration means; in addition, the grille can be retracted from its normal position to a second position in which it is no longer interposed between the two compartments for separation and filtration. It is thus possible, by virtue of this particular arrangement, regularly to clean the dust bag. For this purpose it is sufficient to retract the grille and set the dust bag in vibration so that the dust held in the said bag can fall directly into the storage means, after having passed through the separation compartment.

The grille may be retracted, in particular, by pivoting it about a horizontal axis, integral with the edge of the grille, which is located towards the upper part of the delivery orifice. In this case, during pivoting, the grille is placed along one of the inner faces of the separation compartment, adjoining the first fan.

The dust bag is, for example, fixed onto a support frame and the vibration means may, for example, consist of a handle which is accessible from outside the box and of rubber pads on which the said frame is mounted and which can be subjected to repeated displacements. When cleaning the dust bag, it is sufficient for the operator to grip the handle and impart a few rapid movements to it.

The device of the invention may be placed on independent storage means, for example an open-topped bucket.

According to a first, preferred version of the invention, the storage means consists of a waste container which is located in the box, below the separation compartment; in this case, the device includes connection means between the open face of the separation compartment and the opening of the container. In addition, the box has an access hatch facing the container.

The connection means consists of a part which extends the inner faces of the separation compartment as far as the entry of the container; its shape is, of course, dependent on the shape of the opening of the container. In the case of a cylindrical barrel, the connection part will have, in its upper part, a substantially square cross-section and, in its lower part, a substantially circular cross-section.

The container may also consist of a plastic bag. In this case the edge of the opening of the bag will be fixed around the lower part of the connection part which is preferably circular.

According to another alternative embodiment, the lower face of the separation compartment connects onto the storage means via a compacting screw accommodated in the lower part of the box, so that its feed opening is connected onto the open face of the separation compartment and its discharge opening emerges onto the storage means.

For preference, the discharge opening of the compacting screw emerges from the box through an orifice around which an annular part for fastening the storage means is placed, externally to the said box. In this case, especially when the storage means consists of a plastic bag, it is sufficient for the operator to position the bag around the annular part and fix it, in particular using a strap. The presence of the compacting screw makes it possible to double or triple the time necessary for filling the same plastic bag, which commensurately reduces the time given over to removing the filled bag and replacing it and also to the amount of space taken up for final storage of the full bags.

It is thus seen that, when starting the first fan, and likewise the compacting screw, it is important for storage means to be present in order to collect the waste. In order to prevent the waste from falling directly to the bottom of the box or else out of the device when it includes a compacting screw, it is preferable to provide automatic means for stopping the fan and/or the compacting screw in the case of absence of storage means.

More particularly in the case of a plastic bag fixed onto the annular part, outside the box, the device includes:

a) at least one shutoff contactor whose finger, forming a switch, passes through the said annular part and projects above it, and b) at least one pivoting bar which is arranged above the said finger and the annular part, so that, when the bag is placed around the annular part, this bag is placed above the pivoting bar and, when the bag is being fastened using a fastening tie, such as a strap, the bar pushes in the finger of the contactor by pivoting under the tightening action of the tie.

Thus, by virtue of this particular shutoff system, the fan and the compacting screw cannot be started unless a bag has been placed and fixed onto the annular part, each finger forming a switch then being in the on position.

According to another alternative embodiment, the inner face of the separation compartment connects onto a baling press which also acts as the storage means.

The compacting screw or the baling press makes it possible to compact the waste, which commensurately reduces the frequency of removal of the stored products.

In contrast to the compacting screw, the baling press is not sealed and, because of the overpressure within the box, waste can escape into the room in which the device is located. Consequently, in the case of a device equipped with a baling press, this device will preferably be produced in its version with additional ventilation means.

BRIEF DESCRIPTION OF THE DRAWINGS

The present invention will be better understood on reading the following description of three embodiments of a waste suction and storage mini-unit which are illustrated by the attached drawing in which:

FIG. 2 is a diagrammatic representation of a mini-unit with a compacting screw, FIG. 3 is a partial view of the mini-unit in FIG. 2.

MORE DETAILED DESCRIPTION

Figure 1:
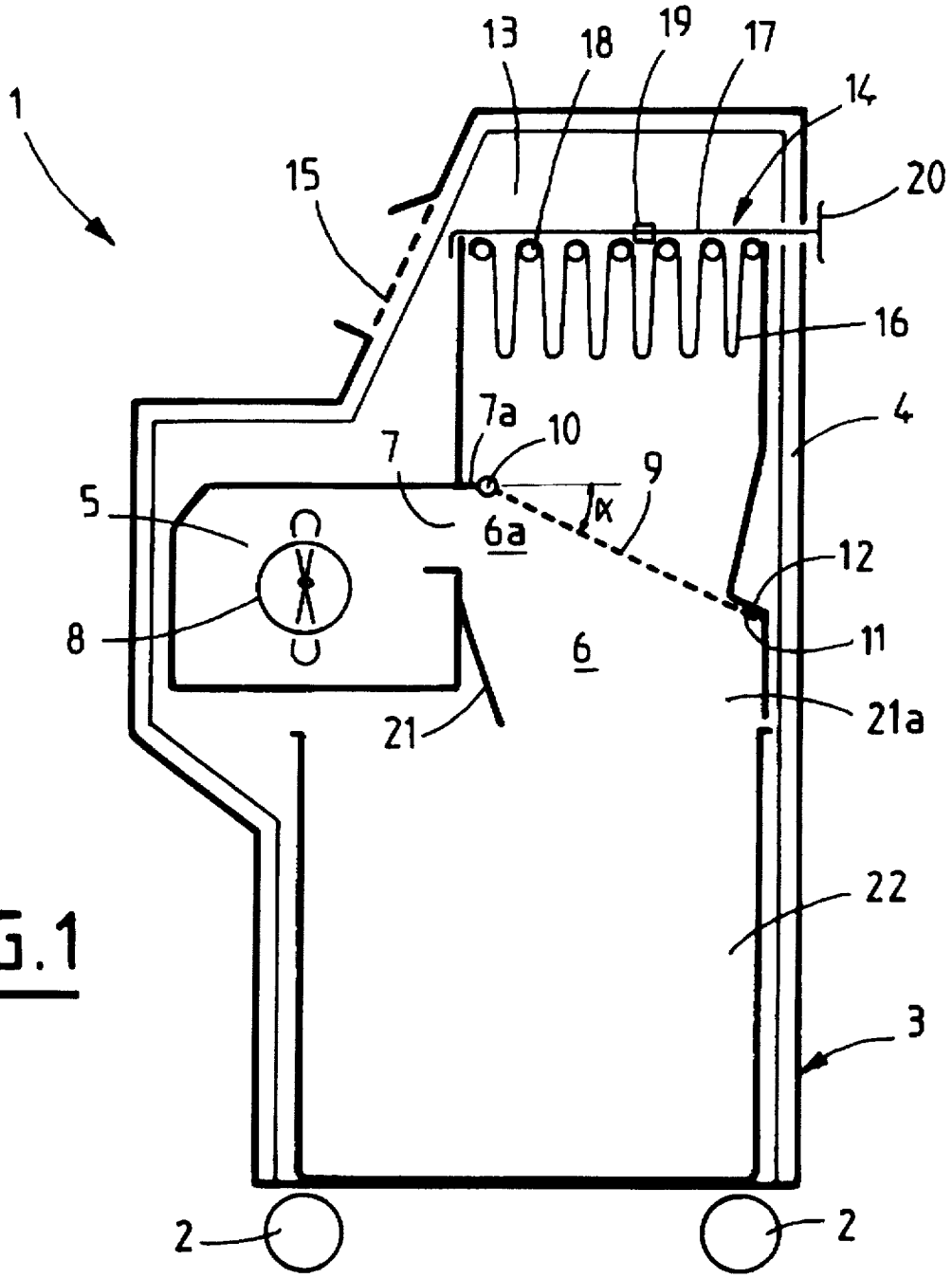
FIG. 1 is a diagrammatic representation of a mini-unit with an incorporated storage barrel.

The mini-unit 1 represented in FIG. 1 has the appearance of a cabinet mounted on castors 2. The outer shell of this cabinet consists of a box 3 lined on the inside with a material 4 suitable for sound insulation. A fan 5, on the one hand, and a compartment 6 of substantially cubic shape, used for separating the delivery air and the waste, on the other hand, are accommodated in the substantially central part of the box 3. The delivery orifice 7 of the fan 5 is placed so that the air flow delivered is projected substantially horizontally into the upper part 6a of the separation compartment 6.

The suction orifice 8 of the fan 5 passes through the box 3 and is connected to a pipe, not shown, intended for collecting the waste. In the case of collecting waste from several production machines in the same room, this pipe may be divided into several branch pipes whose free ends will be placed on the said machines, at the waste production source.

For preference, so as to sound-proof the mini-unit as well as possible, the suction orifice 8 of the fan 5 is extended by a half-silencer flush with the box and the collection pipe is itself terminated by a half-silencer which can be fitted into it and is mounted permanently on the box.

A separation grille 9 occupies the entire cross-section of the separation compartment 6. This grille 9 is fixed by one of its edges to a horizontal axle 10 which is itself fixed along the upper part 7*a* of the delivery orifice 7 of the fan 5. The grille 9 can pivot about the axle 10, its edge 11 which is opposite the said axle 10, being, in the normal position, applied against a stop 12 which is below the level of the axle 10 so that the said grille makes, with respect to the horizontal, an angle $\alpha$ of approximately 20°.

The stop 12 is an upper stop, that is to say that, when it is pivoted about the axle 10, the grille 9 descends until it adopts a substantially vertical position within the separation compartment 6.

The grille 9 is held against the stop 12, in the normal position, for example using a spring system mounted around the axle 10 and pushing the grille 9 upwards.

The pivoting of the grille 9 downwards can be controlled from outside the box using a control wheel mounted on the shaft 10.

The separation compartment 6 has an open upper face which connects into the filtration compartment 13. This compartment includes the filtration system 14 proper as well as an air discharge opening 15 made in the box 3.

The filtration system 14 consists of a dust bag 16 made of canvas which is attached onto and suspended from a metal frame having horizontal cross-members 18 between which the bag 16 hangs in the form of loops, the said loops being held in position using inserts, not shown. The dust bag 16, in the bottom part of the loops, occupies the entire passage cross-section between the separation compartment 6 and the filtration compartment 13.

It should be noted that the filtration system 14 may also be a disposable cassette filter; in this case, the grille 9 has no need to be pivotably mounted.

The metallic frame 17 is mounted flexibly on two rubber joints 19 of the Paulstra type. It is also provided with a handle 20 passing through the box 3.

The lower part of the separation compartment 6 is extended by a connection part which makes it possible to convert the substantially square cross-section of the separation compartment 6 into a substantially circular cross-section. The lower end 21*a* of this connection part 21 has a diameter which is defined as a function of the storage means employed.

In the example represented in FIG. 1, it is a barrel 21 which is placed inside the box 3, below the said end 21*a*. Of course, in this case, the box is provided with an access hatch, not shown, allowing introduction and removal of the storage barrel 22.

The mini-unit 1 operates as follows: the collection pipe or pipes, the free ends of which are placed directly on the production means, convey the waste, by suction, by virtue of the action of the fan 5. This waste and the air sucked in are delivered together through the delivery orifice 7. The presence of the grille 9 makes it possible to separate the delivered air, which preferably passes through the holes in the grille and rises towards the filtration compartment 13, whereas the waste is retained by the grille and is directed towards the barrel 22. The positioning and inclination of the grille 9 are determined with a view to promoting the formation of a film of air on its surface, which allows the waste to slide along it, without risk of catching or accumulation. In addition, the grille 9 is chosen to have an open section which creates a rising air speed such that this speed is insufficient to cause possible lifting of the waste from the barrel 22.

By way of non-limiting example, the fan employed had a flow rate of the order of 1,200 $m^3$/hour with a pressure of 200 millimeters of water. The grille had a mesh size of 2×2 millimeters.

In the case of waste in the form of perforated paper strips of the sprocket-hole strip type, the fan employed included a wheel provided with blades which made it possible to obtain some degree of shredding of the continuous strips, which promotes the air/waste separation.

The delivered air flowing through the grille 9 passes through the dust bag 16, allowing the fine particles contained in this air to be retained. The air thus filtered is reintroduced into the room by passing through the discharge opening 15.

The operator may regularly clean the dust bag 16. It is sufficient for him/her first to cause the grille 9 to pivot until it becomes vertical and leaves free the passage between the separation compartment 6 and the filtration compartment 13. It is sufficient for him/her then to grip the handle 20 and impart repeated movements to it. These movements drive the frame 17, integral with the handle 20, in vibration on the rubber joints 19. This has the effect of shaking the bag 16 and causing the fine particles which have accumulated on the walls of the loops of the bag 16 to fall.

The fine particles which had accumulated in the bag 16 then fall directly into the barrel 22 among the waste.

In the second embodiment illustrated in FIG. 2, the part of the mini-unit 23 which is located above the axis AA' is strictly identical to that which was described before in the first embodiment.

This mini-unit 23 is principally characterized by the presence of a compacting screw 24 which makes it possible to compact the waste recovered before it is introduced into the storage means.

The compacting screw 24 is in the form of a feed screw 25 mounted inside a cylindrical enclosure 26 whose internal diameter is slightly greater than the diameter of the screw 25.

This feed screw 25 is driven using a geared motor, not shown.

The compacting screw 24 is placed in the lower part of the box 3. Its feed opening 27 is connected to the separation compartment 6 using a conversion part 28 which makes it possible to convey all the waste coming from the separation compartment 6 into the feed opening 27. In order to prevent accumulation of waste in the foremost part 30 of the compacting screw 24, the face 29 of the connection part 28 which is located in the extension of the stop 12 is preferably inclined backwards as shown in FIG. 2.

The rear end 31 of the enclosure 26 of the compacting screw 24 passes through the box 3. This end 31 is surrounded, along the box 3, by an annular part 32 for fastening the storage means which, in this case, is in the form of a plastic bag 33. The latter is placed around the annular part 32 and fixed thereon using a tie 34, for example a strap.

The mini-unit 23 operates identically to that which was described previously in the first embodiment, until the waste is introduced into the connection part 28.

The waste falls through the feed opening 27 into the compacting screw 28. Under the action of the feed screw 25, the said waste is driven along and compacted as far as the end 31 of the enclosure 26. It is introduced into the plastic bag 33 and stored therein.

It will be noted that some degree of overpressure is set up inside the box even in the plastic bag 33, so that the latter, if it is air-tight, remains constantly inflated.

The compacting screw used had, in a specific non-limiting embodiment, a diameter of 300 millimeters with a pitch of 300 millimeters, whereas the enclosure 26 had a diameter of 350 millimeters. The rotation of the feed screw 25 was of the order of 30 rpm.

In order to optimize the operation of the mini-unit 23, the geared motor which drives the feed screw 25 in rotation was provided with an intensity detector which made it possible, in the event of variation in the said intensity, to trigger an audible or visual alarm. It will be understood that this variation in intensity is caused by the accumulation of waste within the compacting screw when the storage bag 33 is full.

The fact that the bag 33 is fixed onto the annular part 32 close to the box 3 while the rear end 31 is located largely within the bag makes it possible to prevent the waste from spilling onto the ground when the tie 34 is removed and the bag 33 is closed.

In addition, as shown by FIG. 3, a contactor 35 has been mounted on the annular part 32, which contactor 35 is placed between the said annular part 32 and the end 31 of the enclosure 26, externally to the box 3. This contactor 35 includes a finger 36 which acts as a switch and which passes through a recess 37 provided in the annular part 32. In the normal position, the end of the finger 36 extends beyond the part 32. In addition, a bar 38 is mounted so that it can pivot via one of its edges 39 which is fixed to a pivot axle 40 located at the level of the annular part 32 in proximity to the box 3. In the normal position, this bar 38 is applied onto the finger 36 which extends beyond the annular part 32. In this case, the contactor 35 causes the fan 5 and the compacting screw 24 to stop.

When the bag 33 is placed on the annular part 32, the said bag 33 is placed so that it covers the bar 38. It is fastened using the strap 34 which exerts, by virtue of its elasticity, a compressive force on the bag 33 and therefore on the bar 38. This causes the said bar 38 to pivot about the axle 40. This pivoting causes the finger 36 to be pushed in, which actuates the contactor 35 so that it then becomes possible to start the fan 5 and the compacting screw 24.

By way of a safety measure, it is preferable to provide two contactors 35 on the annular part 32, each contactor interacting with one bar 38.

In the two aforementioned embodiments, the box 3 was mounted on four castors, two of which could pivot in order to facilitate handling within rooms. In both embodiments, the dimensions of the mini-unit were calculated so that it could pass through a conventional door.

Figure 4:
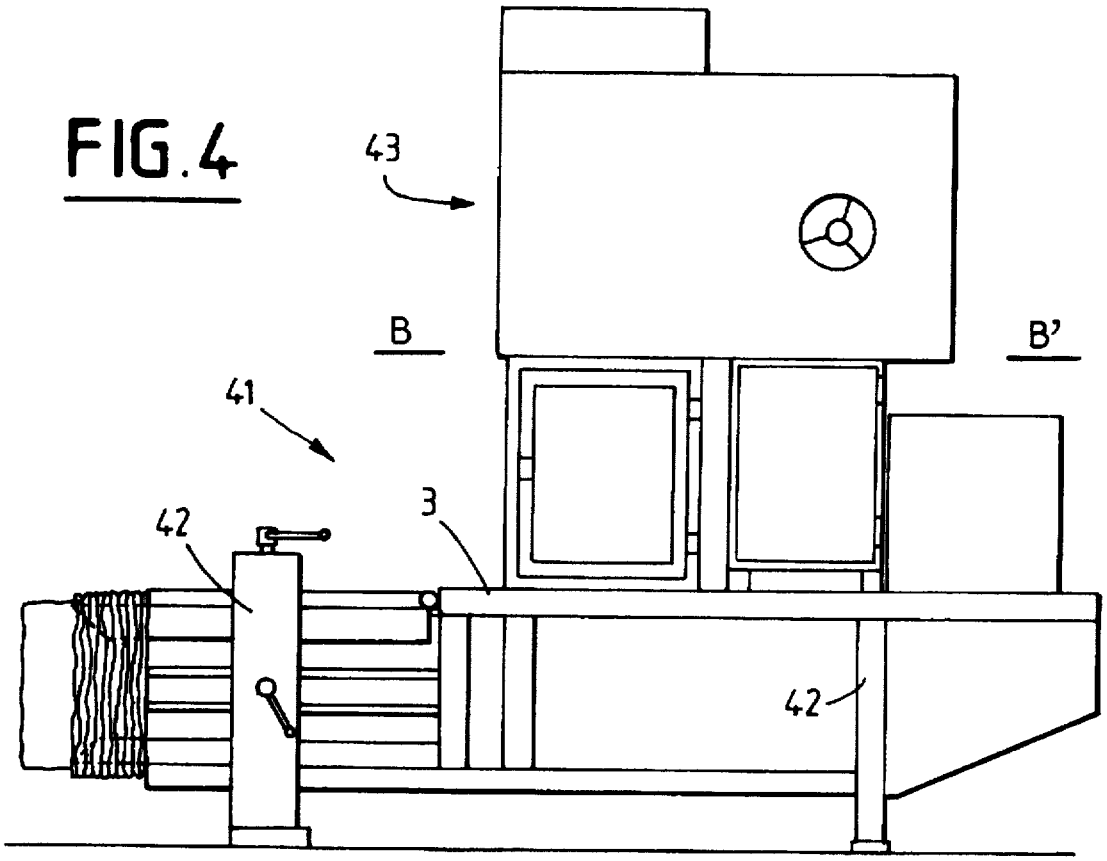
FIG. 4 is a diagrammatic representation of a mini-unit with a baling press.

In the third embodiment, illustrated in FIG. 4, the lower part of the mini-unit 41 which is located below the axis BB' differs from the part of the mini-unit 23 located below the axis AA' principally in that the compacting screw 24 has been replaced by a baling press, which makes it possible to compact the waste more greatly, and in that the box 3 is not mounted on wheels but rests on the ground via four vertical posts 42, only two of which can be seen in FIG. 4. Since baling presses are moreover well known, the description of this lower part of the mini-unit 42 will therefore not be repeated.

Figure 5:
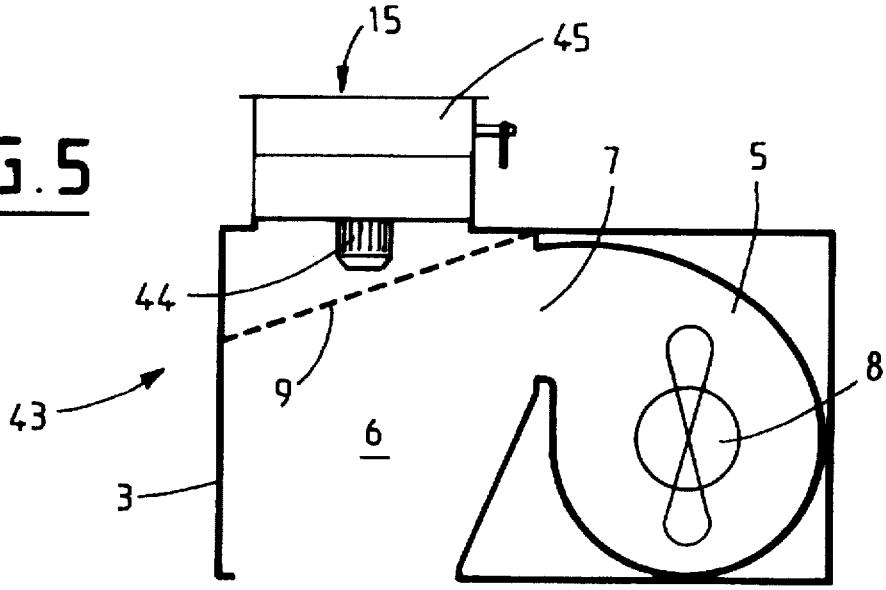
FIG. 5 is a view of the interior of the box of the mini-unit in FIG. 4, at the level of the air/waste separation compartment.

The interior of the upper part 43 of the box 3 which is located above the axis BB' and which is characteristic of the mini-unit 41 is illustrated in FIG. 5. For greater clarity, the elements of this upper part 43 which are found in the part of the box 3 of the mini-unit 23 which is located above the axis AA' have been indicated with the same reference numbers. The upper part 43 of the box 3 of the mini-unit 41 has the particular feature that it comprises no filtration compartment but includes a single separation compartment 6 which communicates with the air discharge opening 15 via a propeller fan 44 fixed inside the box 3 at the level of the discharge opening 15. In addition, since the box includes no filtration system integrated with the box 3, the grille 9 which is interposed between the separation compartment 6 and the discharge opening 15 is fixed and is not pivotably mounted.

When the baling press is on, and in the absence of additional ventilation means, an overpressure which is, for example, of the order of 15 to 20 mm of water is set up inside the box. Given that the baling press is not sealed, this causes waste to be propelled into the room in which the device is located, which is detrimental to correct operation of the mini-unit. The fan 44 has the purpose of causing forced discharge of air through the discharge opening 15 in order to counteract this overpressure phenomenon. The discharge flow rate of air is intended so that only a slight overpressure remains inside the box 3, for example of the order of 5 mm of water, which is sufficient to allow natural discharge of waste to the baling press but is insufficient to throw waste into the room. In order to allow this air discharge flow rate, and therefore the slight residual overpressure, to be regulated, the opening 15 is equipped with a graduated ring 45 which allows a user of the mini-unit 41 manually to adjust the cross-section of the discharge opening 15.

In a precise embodiment, the fan 5 employed had a flow rate of the order of 2,700 $m^3/h$ with a pressure of 300 mm of water and the fan 44 had a flow rate of the order of 3,000 $m^3/h$ with a pressure of 15 mm of water.

It is possible, in the context of the invention, to replace the fan 45 by any ventilation means placed outside the box 3 and connected to the discharge opening. Similarly, the mini-unit 41 might be equipped with a filtration system, placed outside the box 3 and connected to the discharge opening thereof, by means, for example, of a hose or a pipeline, on which flap valves for regulating the overpressure, which are comparable to the graduated ring 45, may be provided. Such an external filtration system might also replace the filtration system 14 which is integrated with the box 3 of the mini-units 1 and 23.

The same mini-units as have been described have been employed with types of waste other than sprocket-hole strips, in particular with polytetrafluoroethylene strips resulting from the machining of plastic parts and also with aluminium pellets collected from production machines.

I claim:

1. Waste suction and storage device, including a box (3) which, comprises waste storage means and at least one separation compartment (6) whose lower part is open and connects with the waste storage means and which is equipped with ventilation means and includes a waste introduction opening and an air discharge opening (15), wherein, the ventilation means comprises at least a first fan (5) which is placed inside the box (3), has its suction orifice (8) connected, towards the outside of the box (3), to a waste collection pipe and has its delivery orifice (7) leading into the upper part (6a) of the separation compartment (6) so that the air flow delivered by the first fan (5) is projected substantially horizontally into the separation compartment (6) and the device furthermore comprises a grille (9), for separation of air and waste, which is interposed between the separation compartment (6) and the discharge opening (15) of the box (3), and which is inclined downwards from the delivery orifice (7) of the first fan (5).

2. Device according to claim 1, wherein the first fan (5) is provided with blades so as to obtain shredding of the waste at the entry of the separation compartment (6).

3. Device according to claim 1, wherein the box (3) furthermore comprises a filtration compartment (13) which is located above the separation compartment (6) and a filtration system (14) which is placed in the filtration compartment (13), between the separation grille (9) and the discharge opening (15) of the box (3).

4. Device according to claim 3, wherein the filtration system (14) comprises a dust bag (6) which is placed just above the separation compartment (6) and which is provided with vibration means, wherein the grille (9) can be retracted from its normal position to a second position in which it is no longer interposed between the two compartments (6,13) for separation and filtration.

5. Device according to claim 4, wherein the grille (9) is retracted by pivoting it about a horizontal axle (10) which is integral with the edge of the grille (9) and which is located towards the upper part of the delivery orifice (7), the grille then being placed along one of the inner faces of the separation compartment (6), adjoining the first fan (5).

6. Device according to claim 4 or 5, wherein the dust bag (16) is fixed on a support frame (17) and the vibration means comprises a handle (20) which is accessible from outside the box (3) and of rubber pads (19) on which the frame (17) is mounted and which can be subjected to repeated displacements by actuation of the handle (20).

7. Device according to claim 1 wherein the storage means comprises a waste container (22) which is located in the box (3), below the separation compartment (6) and wherein the device includes connection means between the open face of the separation compartment and the opening of the container, the box having an access hatch facing the container (22).

8. Device according to claim 1, wherein the lower face of the separation compartment (6) connects with the storage means via a compacting screw (24) accommodated in the lower part of the box (3), so that its feed opening (27) is connected onto the open face of the separation compartment (6) and its discharge opening (31) emerges onto the storage means.

9. Device according to claim 8, wherein the discharge opening (31) of the compacting screw (24) emerges from the box (3) through an orifice around which an annular part (32) for fastening the storage means is placed, externally to the box (3).

10. Device according to claim 9, wherein the storage means comprises a plastic bag (33) fixed onto the annular part (32), outside the box (3), and includes: a) at least one shutoff contactor (35) whose finger (36), forming a switch, passes through the annular part (32) and projects above it, and b) at least one pivoting bar (39) which is arranged above the finger (36) and the annular part (32), so that, when the bag (33) is placed around the annular part (32), this bag (33) is placed above the pivoting bar (36) and, when the bag (33) is being fastened using a fastening tie (34), such as a strap, the bar (36) pushes in the finger (36) of the contactor (35) by pivoting under the tightening action of the tie.

11. Device according to claim 1, which comprises additional ventilation means which are connected to the discharge opening (15) of the box and which makes it possible to discharge the air contained in the box (3) with a flow rate which is sufficient to compensate at least partly for an overpressure inside the box (3).

12. Device according to claim 11, wherein the additional ventilation means comprises of a second fan (44) which is fixed in the box (3) at the level of the discharge opening (15), which discharge opening is equipped with an air flow-rate regulation means of the graduated ring type (45).

13. Device according to one of claims 1, 2, 11 or 12, wherein the lower face of the separation compartment (6) connects onto a baling press which is accommodated in the lower part of the box (3) so that its feed opening is connected onto the open face of the separation compartment (6) and which acts as storage means.

* * * * *